US007975942B2

(12) United States Patent
Martin

(10) Patent No.: US 7,975,942 B2
(45) Date of Patent: Jul. 12, 2011

(54) MODULAR AIR KNIFE AND WEAR PLATE FOR CYCLONIC COMMINUTER

(76) Inventor: Eugene G. Martin, New Holland, PA (US)

( * ) Notice: Subject to any disclaimer, the term of this patent is extended or adjusted under 35 U.S.C. 154(b) by 294 days.

(21) Appl. No.: 12/273,508

(22) Filed: Nov. 18, 2008

(65) Prior Publication Data

US 2010/0123032 A1 May 20, 2010

(51) Int. Cl.

| | |
|---|---|
| ***B02B 1/00*** | (2006.01) |
| ***B02B 5/02*** | (2006.01) |
| ***B02C 11/08*** | (2006.01) |
| ***B07B 4/00*** | (2006.01) |

(52) U.S. Cl. ..... 241/40; 241/285.2; 241/285.3

(58) Field of Classification Search ..... 241/5, 39, 241/40, 285.2, 285.3

See application file for complete search history.

(56) References Cited

U.S. PATENT DOCUMENTS

| | | | | |
|---|---|---|---|---|
| 2,064,109 | A * | 12/1936 | Hadsel | 241/40 |
| 2,562,753 | A | 7/1951 | Trost | 241/39 |
| 5,236,132 | A | 8/1993 | Rowley, Jr. | 241/5 |
| 6,682,005 | B2 * | 1/2004 | Kantonen et al. | 241/5 |
| 6,971,594 | B1 | 12/2005 | Polifka | 241/5 |
| 7,776,262 | B1 * | 8/2010 | Kodis | 422/28 |
| 2002/0027173 | A1 * | 3/2002 | Polifka | 241/5 |
| 2003/0025010 | A1 * | 2/2003 | Ribardi | 241/5 |
| 2003/0080224 | A1 * | 5/2003 | Rowley, Jr. | 241/5 |

* cited by examiner

*Primary Examiner* — Bena Miller
(74) *Attorney, Agent, or Firm* — Miller Law Group, PLLC

(57) ABSTRACT

An air knife module assembly and a replaceable wear plate member are provided for a cyclonic comminuting and dehydrating machine. The air knife and wear plate can be formed in a modular configuration with the wear plate being mountable into an opening formed in the side wall of the cylindrical chamber of the cyclonic comminuter. The air knife module can be formed separately of the wear plate member and mounted into an opening formed in the wear plate module. The wear plate module can be secured to the side wall of the cylindrical chamber by removable fasteners while the air knife module can be secured by clamping members mounted on the wear plate module. Sensors in the air discharge detecting hazardous material above a predetermined threshold are operable to affect a de-naturing of the ground material discharge for removal thereof from the discharged stream of material.

27 Claims, 11 Drawing Sheets

MODULAR AIR KNIFE AND WEAR PLATE FOR CYCLONIC COMMINUTER

FIELD OF THE INVENTION

This invention relates generally to an apparatus for grinding and dehydrating materials and, more particularly, to a modular structure for the input of material into a circular vortex air flow material grinding apparatus.

BACKGROUND OF THE INVENTION

Cyclonic comminuting and dehydration machines have been in use to grind various materials while reducing the moisture content in the material. These cyclonic comminuting and dehydration machines are typically formed with an upper cylindrical portion into which is fed a flow of air and a flow of material. The material to be ground becomes entrained in the air flow circling within the cylindrical portion and moves with substantial velocity while in the machine. The cyclonic comminuting and dehydration machine is also formed with a conical portion joined to the cylindrical portion and extending downwardly therefrom. The bottom of the conical portion is formed with a central opening through which the ground material is discharged. The air flow is discharged along with any moisture carried by the air through a central opening in the top of the cylindrical portion.

In one form of the cyclonic comminuter, the material to be ground is entrained in the air flow before being introduced into the cylindrical portion of the cyclonic comminuter, such as is found in U.S. Pat. No. 5,236,132, granted to Frank Rowley, Jr. on Aug. 17, 1993. The material is fed through an air lock mechanism into an air flow created by a fan so as to have a substantial velocity before being introduced into the cylindrical portion of the machine. A variation of the cyclonic comminution and dehydration machine can be found in U.S. Pat. No. 6,971,594, issued on Dec. 6, 2005, to Francis D. Polifka, wherein the air is compressed and fed into the cylindrical portion of the cyclonic comminuter under pressure. The material to be ground is introduced into the cylindrical portion through a separate infeed opening, preferably through the top plate of the cylindrical portion of the machine.

In the aforementioned Polifka patent, the air is introduced into the cylindrical portion of the cyclonic comminuter through a vertically oriented slot formed into the sidewall of the cylindrical portion. The air inlet is formed at an angle through the side wall to direct the flow of air into a counterclockwise direction, when viewed downwardly from the top of the cylindrical portion. A deflector is attached to the interior face of the side wall in front of the air inlet slot, i.e. immediately upstream of the air inlet slot, to deflect the air flow having material entrained therein away from the air inlet slot, thus guarding the air flow entering the cylindrical chamber. The air inlet slot is fixed with respect to the cylindrical chamber as the air inlet is a defined opening in the structure of the side wall of the cylindrical chamber. Three or four of the air inlets are spaced equidistantly around the circumference of the interior side wall of the cylindrical chamber.

Another representative example of such prior art grinding devices utilizing an air flow can be found in U.S. Pat. No. 2,562,753 granted on Jul. 31, 1951, to Conrad Trost, wherein an anvil grinder includes a cyclonic chamber in communication with a grinding chamber. An upper portion of the cyclone chamber extends upwardly through the grinding chamber such that the grinding chamber surrounds an upper end of the cyclonic chamber but is separated therefrom. Only the upper ends of the grinding and cyclone chamber are in communication along an upper passageway extending around and above the entrance to an air discharge stack. This grinding machine does not have an upper portion of the cyclonic chamber that is cylindrical and separated from the grinding chamber, so the cyclonic chamber does not augment a vortex air flow created in the grinding chamber. The ground material in the Trost machine must drastically change direction of movement and be entrained in the air flow to go from the grinding chamber to the cyclone chamber in order to rise over the upper end of the cyclonic chamber.

Moving air with material entrained therein to be ground within the cyclonic comminuter causes wear on the interior surface of the side wall of the cylindrical chamber, particularly downstream of a deflector, as is disclosed in the aforementioned Polifka patent, U.S. Pat. No. 6,971,594. As a result, portions or the entire side wall of the cylindrical would require replacement due to excessive wear. The replacement of all or a portion of the cylindrical side wall is a difficult task to accomplish as the weld between the original cyclonic comminuter structure and the replacement structure must be air tight due to the utilization of rapidly moving air under pressure. The size of the air inlet slot can vary when pressure of the air inflow is desired to be changes. Accordingly, the configuration of the air inlet slot in the Polifka patent is limited to a relatively small range of pressure that can be fed effectively into the comminuter.

It would be desirable to provide a cyclonic comminuting and dehydrating machine that can be utilized in the grinding of materials to provide an apparatus for effective replacement of portions of the side wall subject to excessive wear from the materials entrained within the air flow in the cylindrical portion of the machine. It would also be desirable to provide a structure through which the size of the air inlet opening can be varied to effectively change pressure of the air being introduced into the cylindrical chamber.

SUMMARY OF THE INVENTION

It is an object of this invention to overcome the aforementioned disadvantages of the prior art by providing a modular air knife structure for deployment in the cylindrical portion of the cyclonic comminuter.

It is another object of this invention to provide a replaceable wear surface for deployment on the interior surface of the cylindrical chamber of the cyclonic comminuter.

It is a feature of this invention that the modular air knife and the replaceable wear plate can be formed in the same modular structure.

It is an advantage of this invention that the modular structure is formed to mate into an opening formed into the side wall of the cylindrical chamber.

It is another feature of this invention that the modular air knife structure can be clamped into position within the opening formed in the cylindrical chamber.

It is another advantage of this invention that the modular air knife structure can be quickly and easily replaced.

It is still another feature of this invention that the air knife is formed as a slotted opening that is oriented generally tangentially to the adjacent surface of the modular structure.

It is yet another feature of this invention that the modular air knife structure does not incorporate a deflector to guard the air knife opening.

It is still another advantage of this invention that the air flow moving past the air knife opening is allowed to mingle with the air flow entering the cylindrical chamber.

It is still another feature of this invention that the replaceable wear plate is formed in an arcuate shape to conform to the adjacent interior surface of the side wall of the cylindrical chamber.

It is yet another feature of this invention that the replaceable wear plate is formed as one modular structure mountable within an opening formed in the side wall of the cylindrical chamber, and the air knife is formed as a separate module that is clamped onto the wear plate module to fit within an opening formed in the air plate module.

It is yet another advantage of this invention that the wear plate structure can be mounted to the exterior of the cylindrical chamber by removable fasteners, while the air knife module can be clamped onto the wear plate module to permit a rapid exchange thereof.

It is still another object of this invention to improve the infeed of material into the cylindrical chamber.

It is another feature of this invention that the cylindrical chamber can be formed of multiple arcuate segments that are secured together to form a cylindrical configuration.

It is another advantage of this invention that each of the arcuate segments can be formed with an opening for the installation of the air knife and wear plate module.

It is still another feature of this invention that the material infeed port in located in the top plate of the cylindrical chamber.

It is yet another feature of this invention that the material infeed port is located at a middle portion of the top plate of the cylindrical chamber between the side wall and the center air discharge opening through the top plate.

It is yet another object of this invention to provide a modular air knife assembly for deployment in a cyclonic comminuter, which is durable in construction, inexpensive of manufacture, carefree of maintenance, facile in assemblage, and simple and effective in use.

It is a further object of this invention to provide a replaceable wear plate member to be deployed downstream of an air inlet for a cyclonic comminuter, which is durable in construction, inexpensive of manufacture, carefree of maintenance, facile in assemblage, and simple and effective in use.

These and other objects, features and advantages are accomplished according to the instant invention by providing an air knife module assembly and a replaceable wear plate member for a cyclonic comminuting and dehydrating machine. The air knife and the wear plate can be formed in a modular configuration with the wear plate being mountable into an opening formed in the side wall of the cylindrical chamber of the cyclonic comminuter. The air knife module can be formed separately of the wear plate member and mounted into an opening formed in the wear plate module. The wear plate module can be secured to the side wall of the cylindrical chamber by removable fasteners while the air knife module can be secured by clamping members mounted on the wear plate module. The infeed opening for material to be ground is located at a mid-part of the top plate of the cylindrical chamber between the side wall and the central discharge opening for air from the cylindrical chamber. Sensors in the air discharge detecting hazardous material above a predetermined threshold are operable to affect a de-naturing of the ground material discharge for removal thereof from the discharged stream of material.

BRIEF DESCRIPTION OF THE DRAWINGS

The advantages of this invention will be apparent upon consideration of the following detailed disclosure of the invention, especially when taken in conjunction with the accompanying drawings wherein.

DETAILED DESCRIPTION OF THE PREFERRED EMBODIMENT

Figure 1:
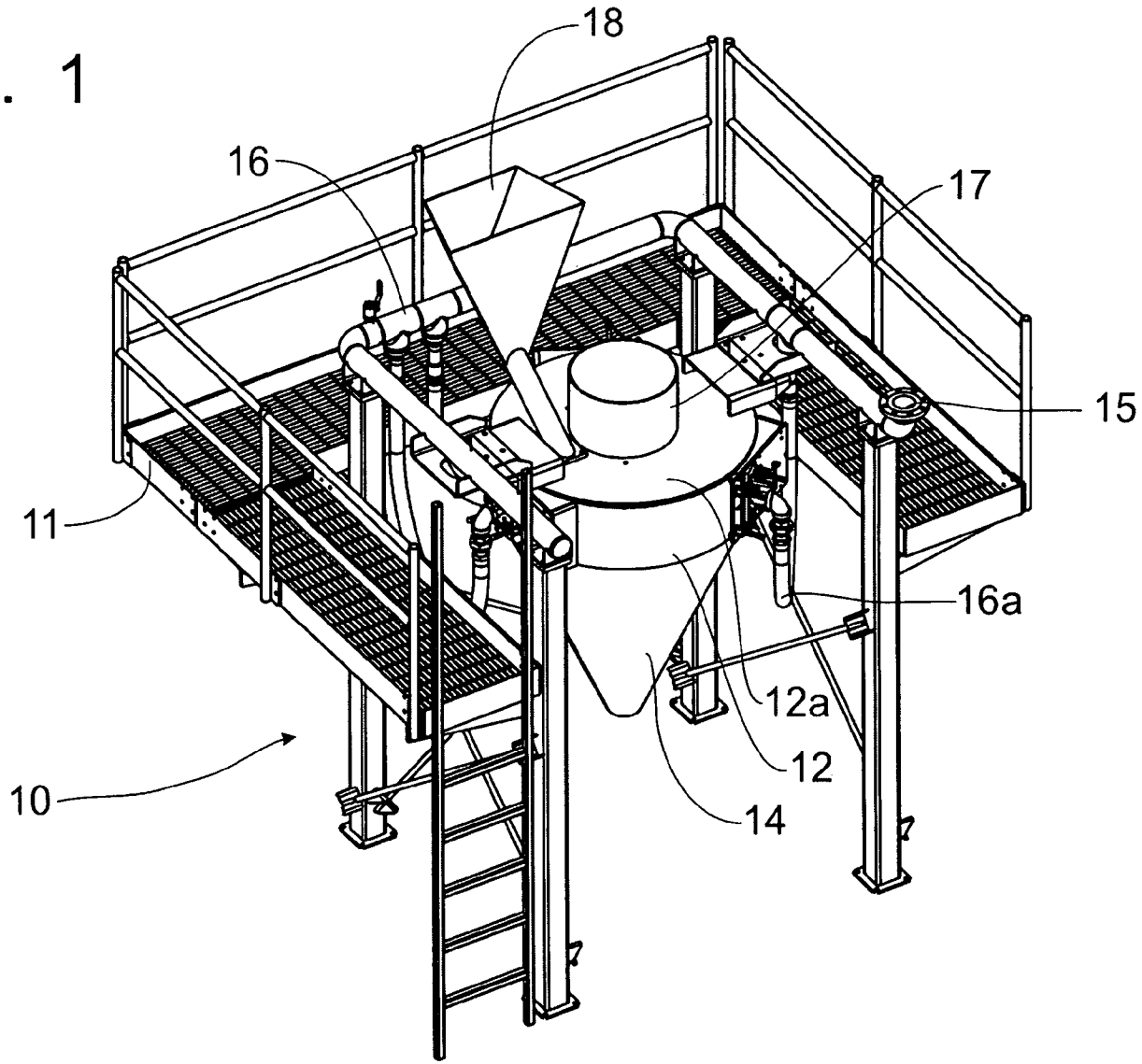
FIG. 1 is a perspective view of a cyclonic comminuting and dehydrating machine having a modular air knife assembly incorporating the principles of the instant invention.
Figure 2:
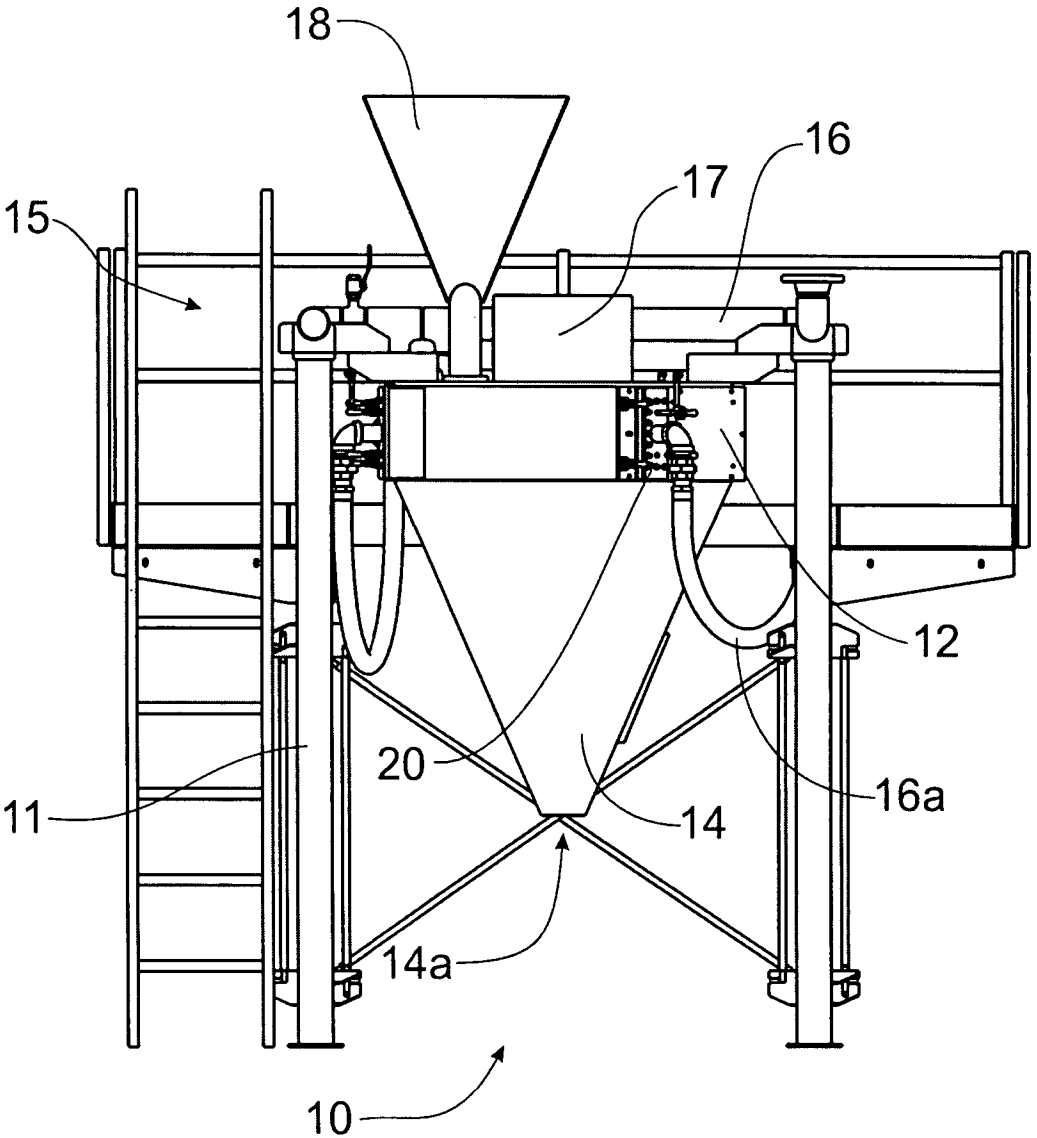
FIG. 2 is an elevational view of the comminuting and dehydrating machine depicted in FIG. 1.
Figure 3:
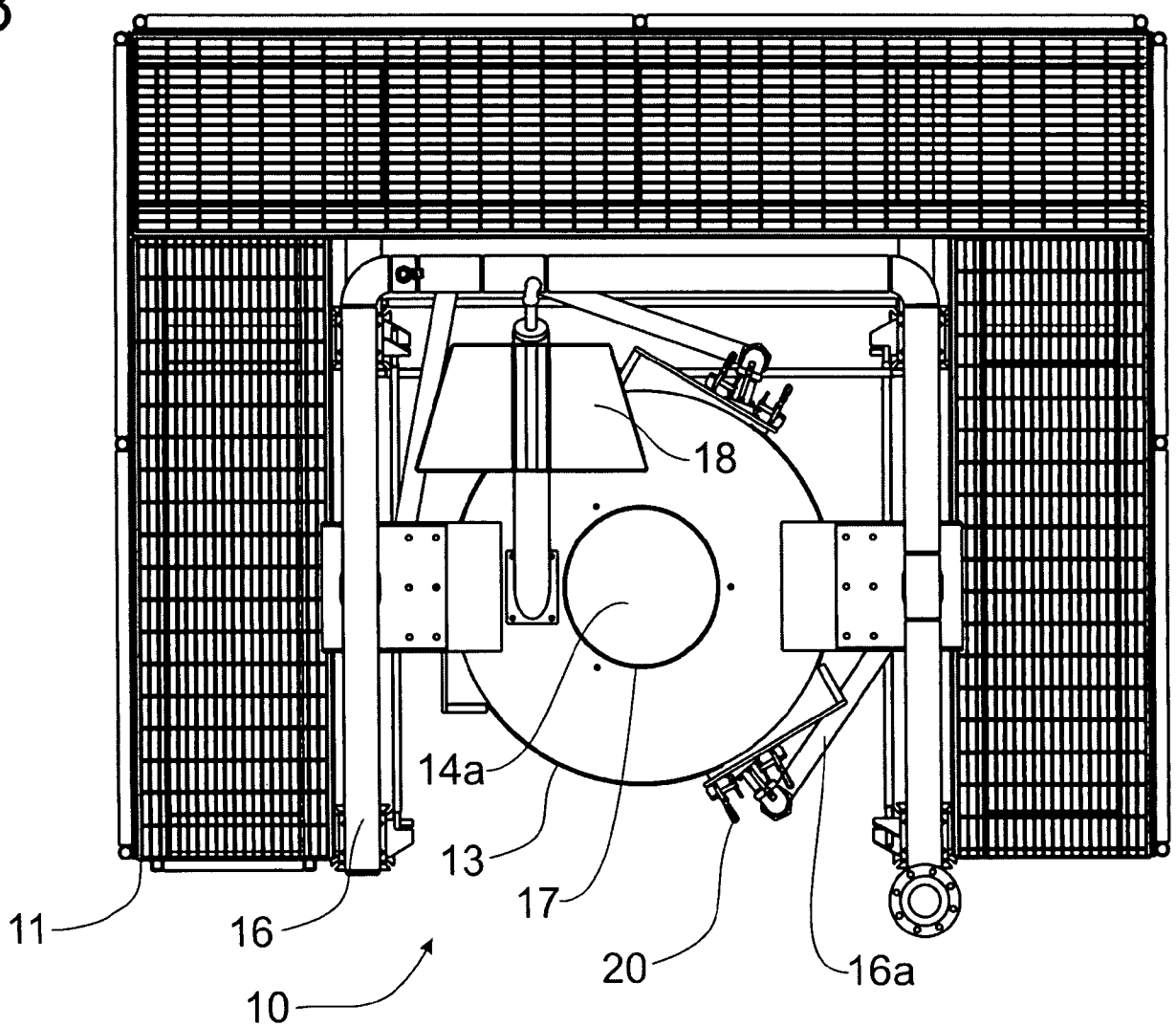
FIG. 3 is a top plan view of the comminuting and dehydrating machine depicted in FIG. 2.

Referring to the drawings, and particularly to FIGS. 1-3, a cyclonic comminuting and dehydration machine incorporating the principles of the instant invention can best be seen. The cyclonic comminuting and dehydration machine 10 utilizes a flow of low volume, high pressure air to create a vortex within the machine to grind material fed into the machine 10. The machine 10 is formed with an upper cylindrical chamber 12, a lower conical chamber 14, an air infeed mechanism 15, an air discharge apparatus 17 and an infeed mechanism 18 for delivering a flow of material to be ground within the machine 10. The machine is preferably supported in a generally vertical orientation by a support frame 11. The air infeed mechanism 15 includes conduits 16 delivering a flow of high pressure air to the respective air knives 20, as described in greater detail below, for delivery into the interior of the cylindrical chamber 12. Ultimately, air is discharged from the machine 10 upwardly through the air discharge mechanism 18, while the ground material falls by gravity along the conical chamber 14 to be discharged through the central discharge opening 14*a*.

The upper cylindrical chamber 12 is formed with a continuous annular sidewall 13 that has an interior side 13*a* and an exterior side 13*b*. The cylindrical chamber 12 is connected directly to and mated with the conical chamber 14 so that material ground within the cylindrical chamber 12 will pass into the conical chamber 14 for discharge from the machine 10 through the opening 14*a*. The cylindrical chamber 12 has a top plate 12*a* that forms a ceiling for the cylindrical chamber 12. The air discharge apparatus 17 is formed as a vertically oriented tube that passes through the top plate 12*a* to deliver air from within the machine 10 to a remote location away from the machine 10. One skilled in the art will recognize that the discharged air may have to be passed through filters and other mechanisms and devices to cleanse the air of any impurities that may be associated with the grinding of the material being fed into the cylindrical chamber 12. The joints between the top plate 12*a* and the side walls 13, as well as between the side walls 13 of the cylindrical chamber 12 and the top edge of the conical chamber 14 are air tight to keep the flow of air and entrained material within the machine 10.

In operation, the high pressure cyclonic comminuter 10 receives a high pressure flow of air from the air compressor (not shown) via infeed ducts 16 supported on the frame 11 and connected by flexible hoses 16*a* to the respective air knives 20 spaced equidistantly around the circumference of cylindrical chamber 12, preferably three or four air knives 20 spaced uniformly at intervals around the circumference of the cylindrical chamber 12. As will be described in greater detail below, the air knives 20 are oriented to direct an air flow in a counterclockwise direction, when viewed from the top, around the outer circumference of the side walls 13 along the interior side 13*a*.

The material to be ground is placed into the from the infeed mechanism 18 and dropped into the cylindrical chamber 12, preferably through an opening in the top plate 12*a* that is positioned near the middle portion of the top plate between the side wall 13 and the air discharge tube 17 passing through the top plate 12*a*. The material entrained in the air flow around the circumference of the cylindrical chamber 12 is moved outwardly toward the interior side 13*a* of the side wall 13 through centrifugal force to effect a grinding of the material. Optional rasp bars or other members (not shown) could be provided on the outer wall of the upper chamber 12 to induce a greater aggressiveness to the comminuting action.

The exact mechanism that causes the grinding and reduction of the material within the machine 10 is not known. Several different theories of its operation are that the grinding results from the pieces of material forcefully colliding with each other or the centrifugal force of the vortex moving the material forcefully against the side wall 13 of the cylindrical chamber 12, or the difference of pressure and vacuum causing the material to loose unity or integrity or to implode due to the vortex created by the rotating air. It has been noted that when the apparatus 10 is in operation, the center of the vortex has dead air (low pressure) space from the lower end of the discharge tube 17 to the opening 14*a* at the bottom of the conical chamber 14.

Another dead air (low pressure) space is found along the interior of the side wall 13 of the conical chamber 14 allowing the processed material to drop down to the bottom of the conical chamber 14 and exit through the opening 14*a*. A vacuum is formed between the dead air in the center of the apparatus 10 and the dead air space along the perimeter of the lower enclosure 14. Also, because of the wear patterns encountered in the side wall portions immediately downstream of the air knives 20, it is theorized that the mixture of air and material circulating the cylindrical chamber 12 may undergo mini-vortexes when mixing with the inflow of high pressure air discharged from the air knife 20 to provide further disruptive forces on the material being ground.

Figure 8:
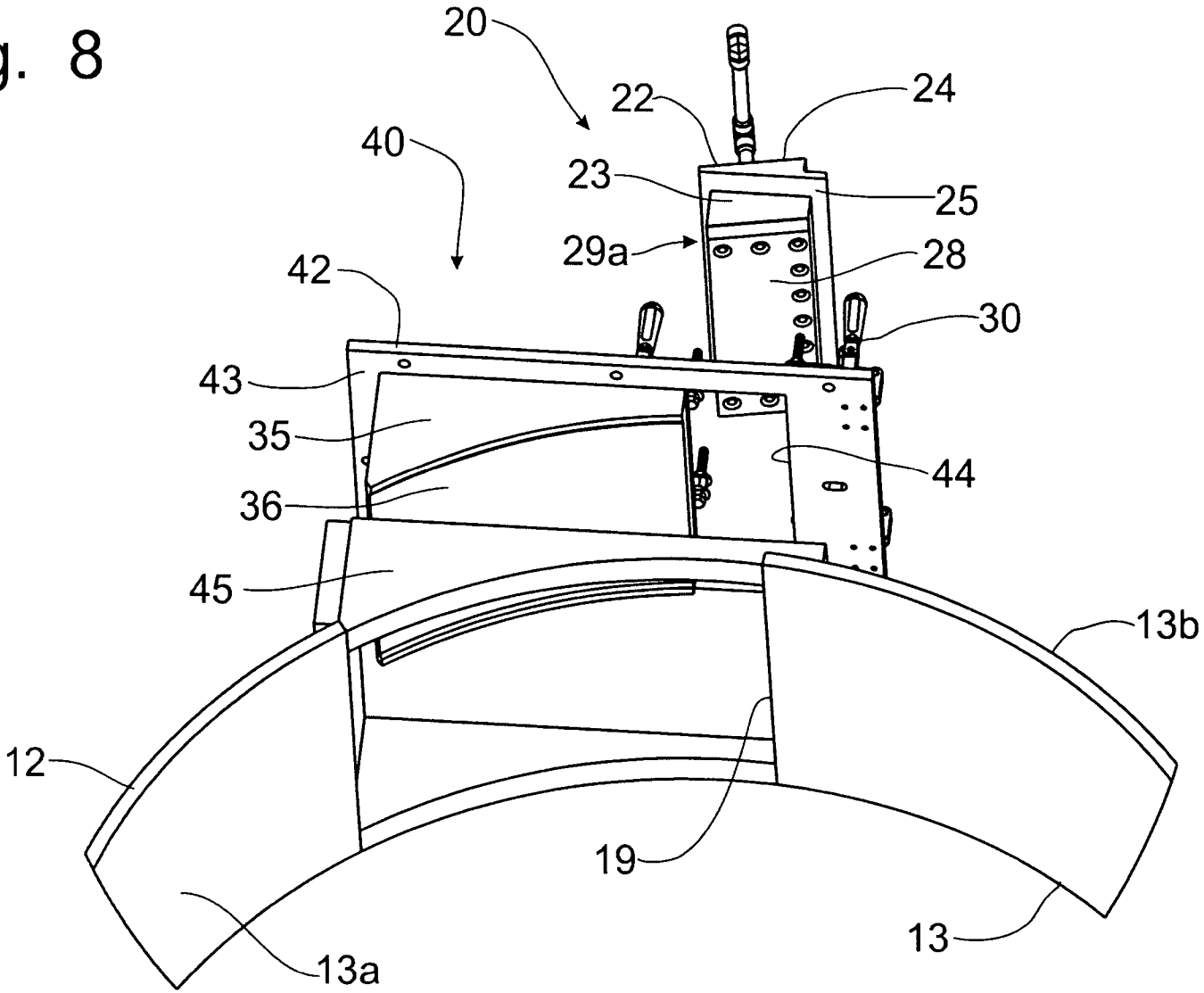
FIG. 8 is an exploded partial detail view similar to that of FIG. 7, but with the wear plate and air knife modules being exploded away from the side wall of the cylindrical chamber.
Figure 9:
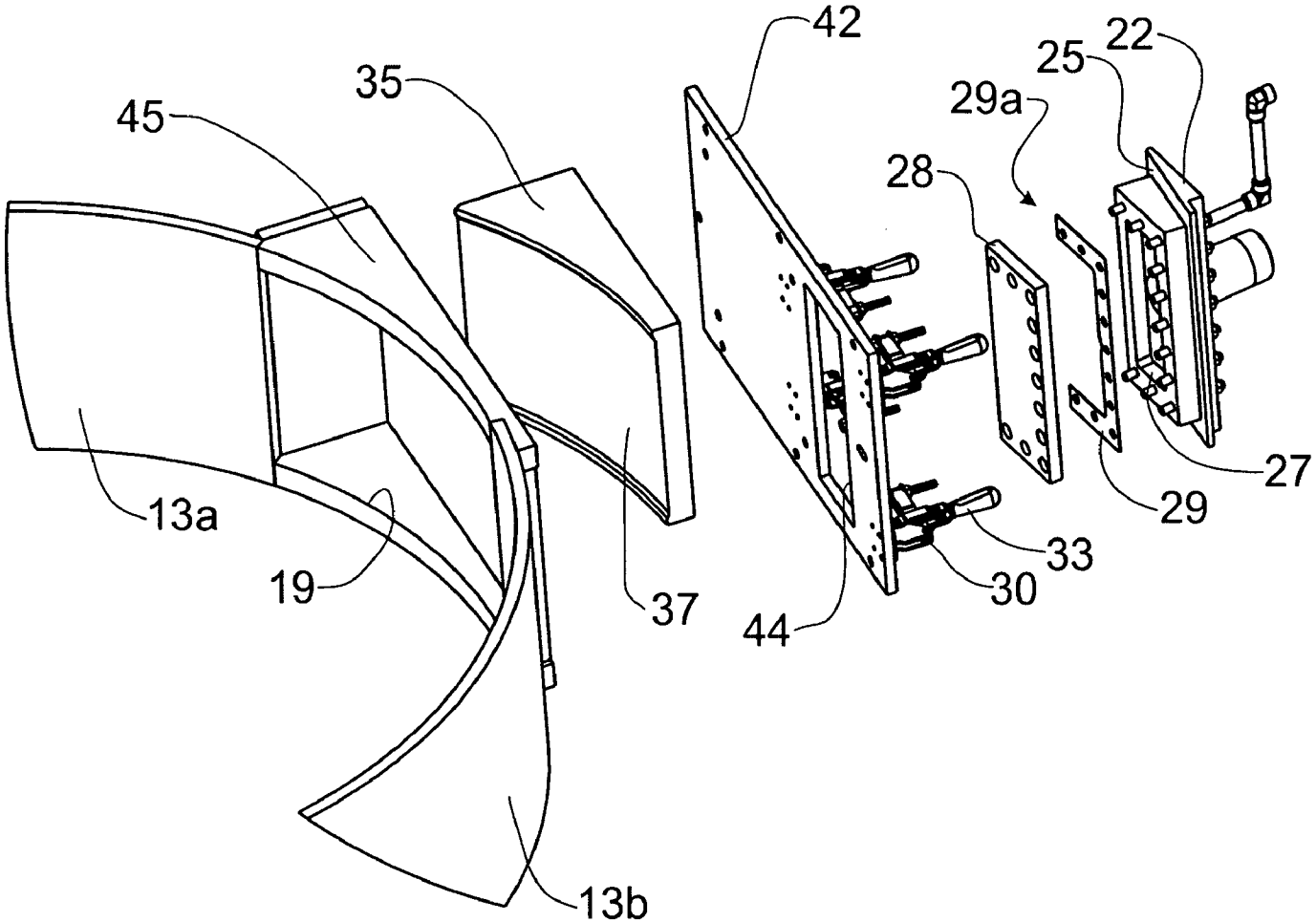
FIG. 9 is a side perspective exploded view of a portion of the cylindrical chamber with the wear plate and air knife modules being exploded away from the side wall.
Figure 10:
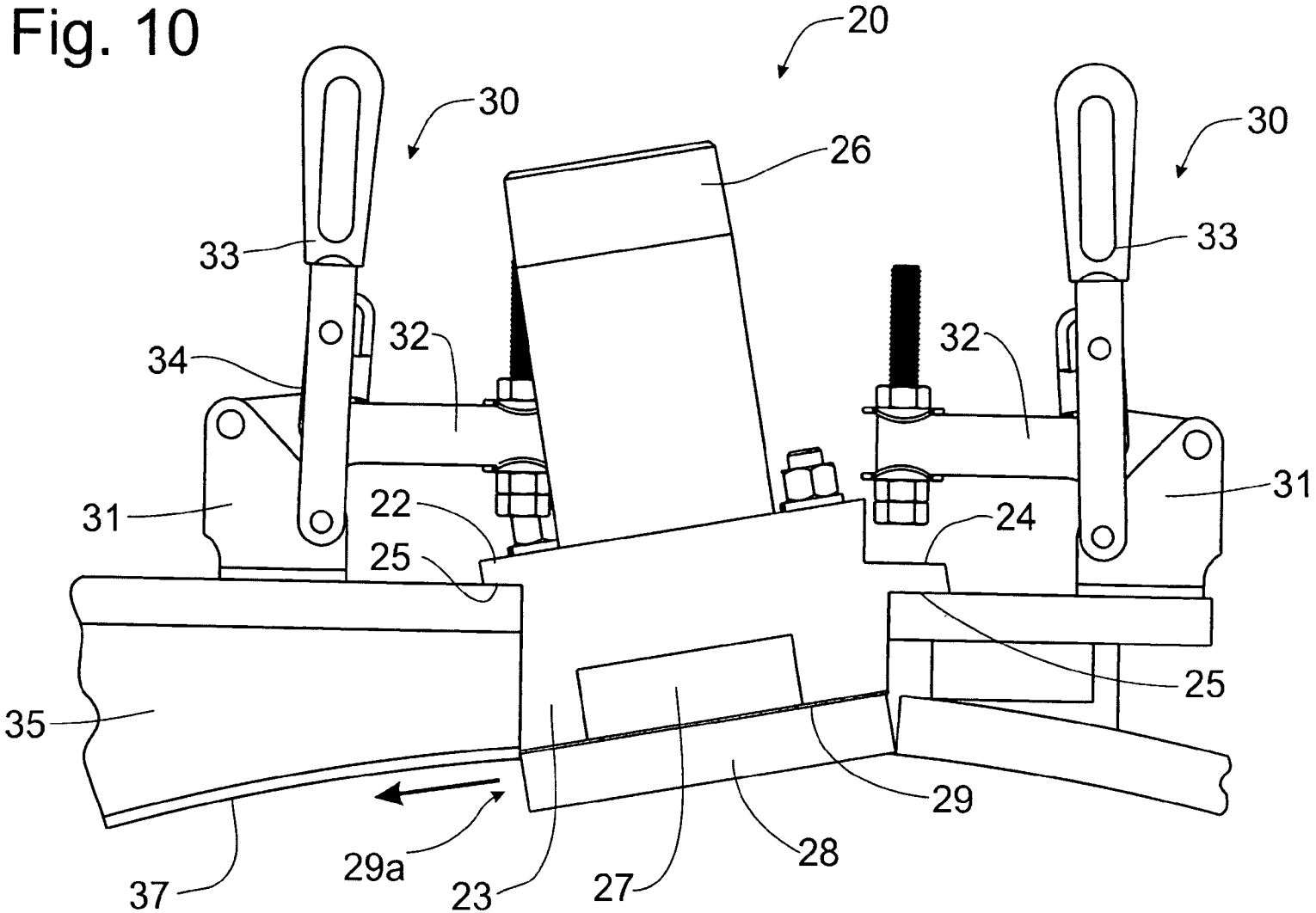
FIG. 10 is an enlarged top plan view of the air knife module positioned with the clamping members being released for the removal of the air knife module.

The air knife 20 is provided to provide a uniform flow of high pressure air into the cylindrical chamber 12. The air knife 20 is best seen in FIGS. 8-10 and comprises an outer housing block 22 formed with an inner portion 23 that projects into the interior of the cylindrical chamber 12 and an outer portion 24 that is larger than the inner portion 23 and defines a lip 25 extending around the perimeter of the inner portion 23. As is best seen in FIG. 10, the lip 25 is formed in a manner that creates the inner portion 23 in a wedge shape that is thicker at the downstream side than at the upstream side. The housing block 22 has a stub tube 26 affixed thereto on the outer portion 24 to connect to one of the flexible conduits 16*a* to receive a flow of high pressure air therefrom. The housing block 22 has a hollow central portion 27 that is in flow communication with the stub tube connector 26.

A solid block member 28 is secured by fasteners to the housing block 22 to cap the hollow central portion 27. A gasket 29 is positioned between the block member 28 and the inner portion 23 to seal the joint between the block member 28 and the inner portion 23. The gasket 29, however, is only formed with three sides leaving a fourth side along the downstream side of the housing block 22 unsealed and creating a slot 29*a* having a thickness equivalent to the thickness of the gasket 29. The slot 29*a* can have a minimum dimension milled into the block 22 while the gasket 29 is used to vary the height or size of the opening 29*a*. The orientation of the slot 29*a* is such that pressurized air is directed along the interior surface 13*a* of the side wall 13 substantially tangentially to the arcuate side wall 13. The minimum thickness of the slot 29*a* is approximately $^{25}/_{1000}$ of an inch, while the gasket 29 will have a thickness from $^{1}/_{1000}$ to perhaps $^{5}/_{1000}$ of an inch to vary the size of the 29*a* between the range of about $^{25}/_{1000}$ to about $^{30}/_{1000}$ of an inch. The higher the air pressure to be utilized, the narrower the slot 29*a* becomes. To change the air pressure of the air flow into the cylindrical chamber 12, the air knife assembly 20 can be disassembled by removing the block member 28 from the inner portion 23 of the housing block 22 and replacing the gasket 29*a*.

Figure 5:
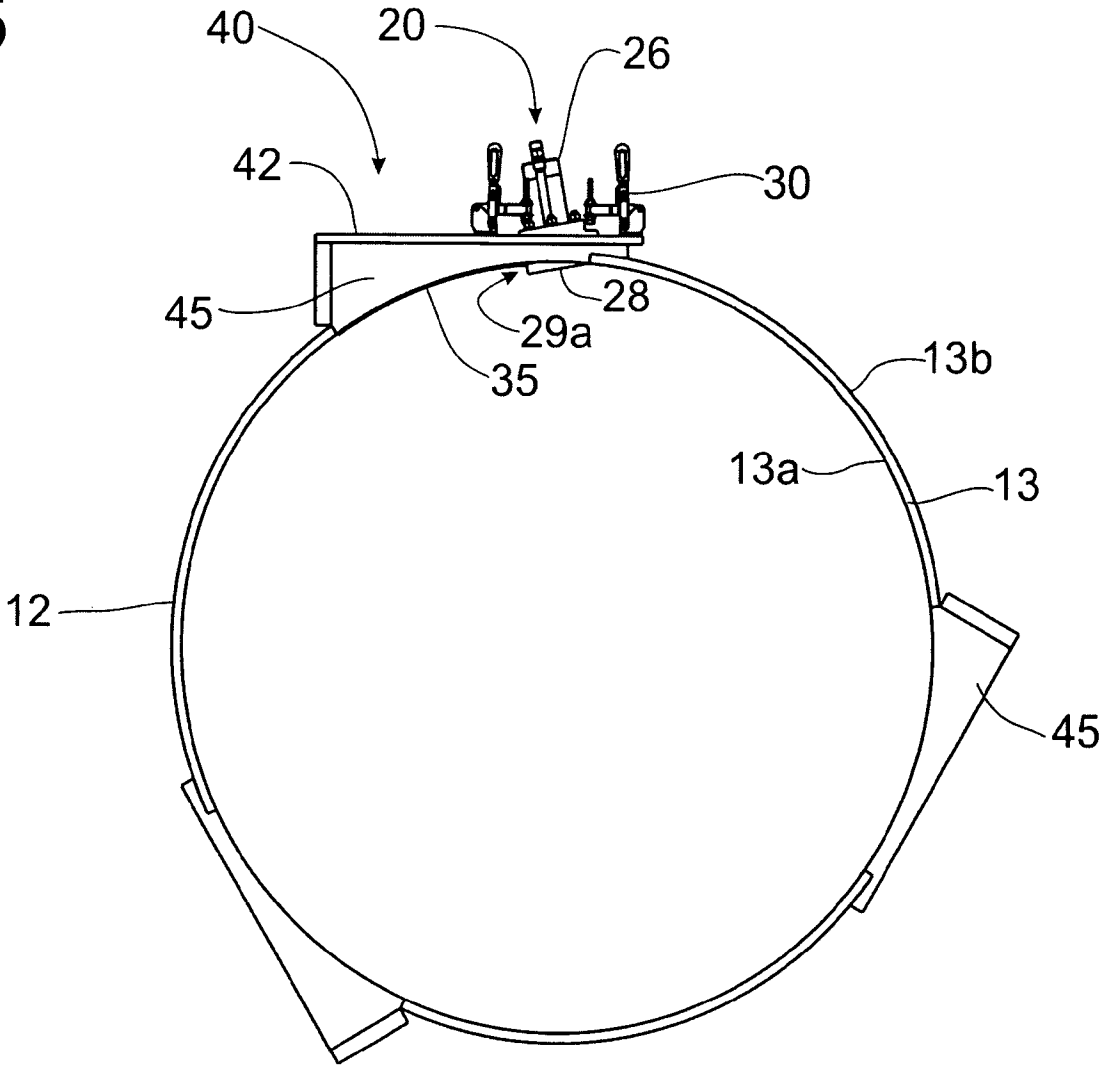
FIG. 5 is a top plan view of the cylindrical chamber with an alternative embodiment of a modular combination wear plate and air knife assembly, a representative air knife and wear plate module being shown, the conical chamber and structure other than the side wall of the cylindrical chamber being removed for purposes of clarity.
Figure 7:
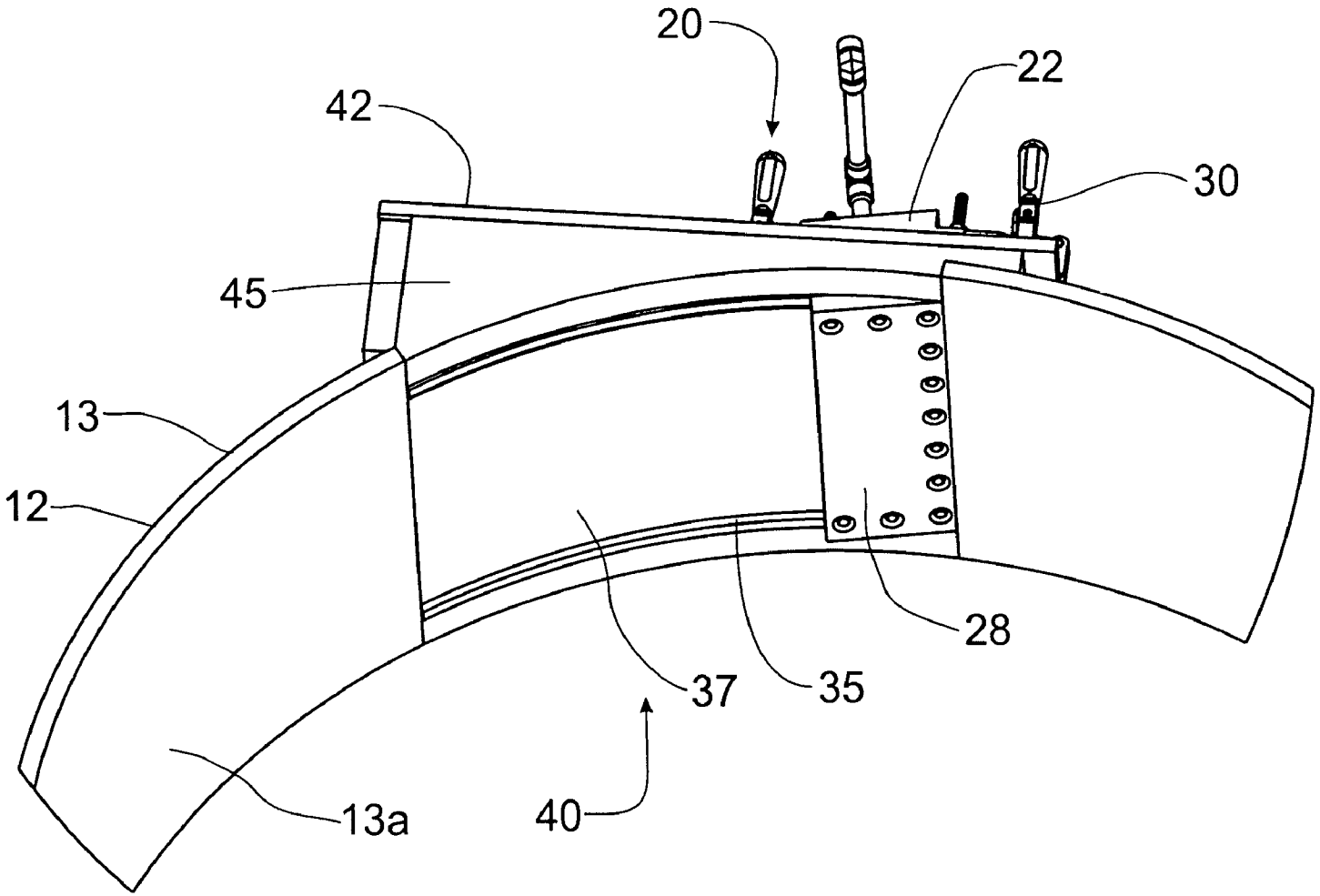
FIG. 7 is an enlarged partial detail view of a wear plate and air knife module of FIG. 6 mounted on the side wall of the cylindrical chamber.

As is best seen in FIGS. 5, 7 and 10, the air knife assembly 20 is configured so that the upstream edge of the block member 28 is flush with the interior side 13*a* of the side wall 13 immediately adjacent to the air knife assembly 20. The downstream side of the air knife assembly 20 projects into the cylindrical chamber 12 a sufficient distance to clear the slot 29*a* past the interior face 13*a* of the side wall 13. Thus, the block member 28 is slightly angled into the interior of the cylindrical chamber 12 and directs the air flow within the cylindrical chamber 12 inwardly slightly. After passing the end of the block member 28, the air flow entrained with material moving around the circumference of the cylindrical chamber 12 moves outwardly into the high pressure air flow exiting the air knife assembly 20 to create interference therewith and provide disruptive forces that grind the entrained material. This interference between the incoming high pressure air flow from the air knife 20 and the entrained air flow moving around the interior of the cylindrical chamber 12 causes a concentrated wear on the side wall 13 immediately downstream of the air knife 20.

Accordingly, the air knife assembly 20 is formed as a modular apparatus that fits into an opening formed into the side wall 13 of the cylindrical chamber 12 that is substantially larger than the slot 29*a* through which the high pressure air is fed into the cylindrical chamber 12. This air knife module 20 can be removed from the side wall 13 and replaced with a different air knife module 20, particularly if the block member 28 is showing signs of wear. Alternatively, the air knife assembly 20 can be reconfigured with a different sized gasket 29 to define a slot 29*a* of desired size.

This air knife module 20 is preferably secured into the opening formed into the side wall 13 therefor by overcenter clamping members 30 that are secured to the outer surface 13*b* of the side wall 13 proximate to the air knife opening. The clamping members 30 have a base member 31 on which is pivotally mounted a clamping arm 32 and an overcenter lever 33. The lever 33 is also pivotally connected to the clamping arm 32 through links 34. The arrangement of the clamping member components is such that the movement of the lever 33 from an upright position shown in FIGS. 5, 7 and 10 against the side wall 13 forces the clamping arm 32 downwardly with the lever 33 being in an overcenter configuration. With this clamping movement, the clamping arm 32 pushes the lip 25 into engagement with the structure surrounding the opening for the air knife module 20. An optional O-ring can be positioned between the lip 25 and the engaged structure to seal the air knife module 20 against the adjacent structure.

To compensate for the heavy wear encountered in the side walls 13 downstream of the air knife module 20, a wear plate 35 is mounted on the side wall 13 adjacent each respective air knife 20. The wear plate is preferably formed of hardened material, such as heat treated steel, to provide an enhanced wear resistance to the disruptive forces created by the intermingling of the entrained air within the cylindrical chamber 12 and the high pressure air flow exiting the air knife assembly 20. The wear plate 35 has a vertical height substantially equal to the corresponding vertical height of the slot 29*a* in the air knife assembly 20. The vertical height of both the wear plate 35 and the air knife assembly 20 is substantially the same as the vertical height of the side wall 13. The wear plate 35 can be a separate member that is welded to the interior surface 13*a* of the side wall 13, preferably into a corresponding pocket 37 formed in the side wall 13, as is reflected in FIG. 4, so that the edges of the wear plate 35 do not project inwardly of the side wall 13 and disrupt the entrained air flow moving around the cylindrical chamber 12.

Figure 6:
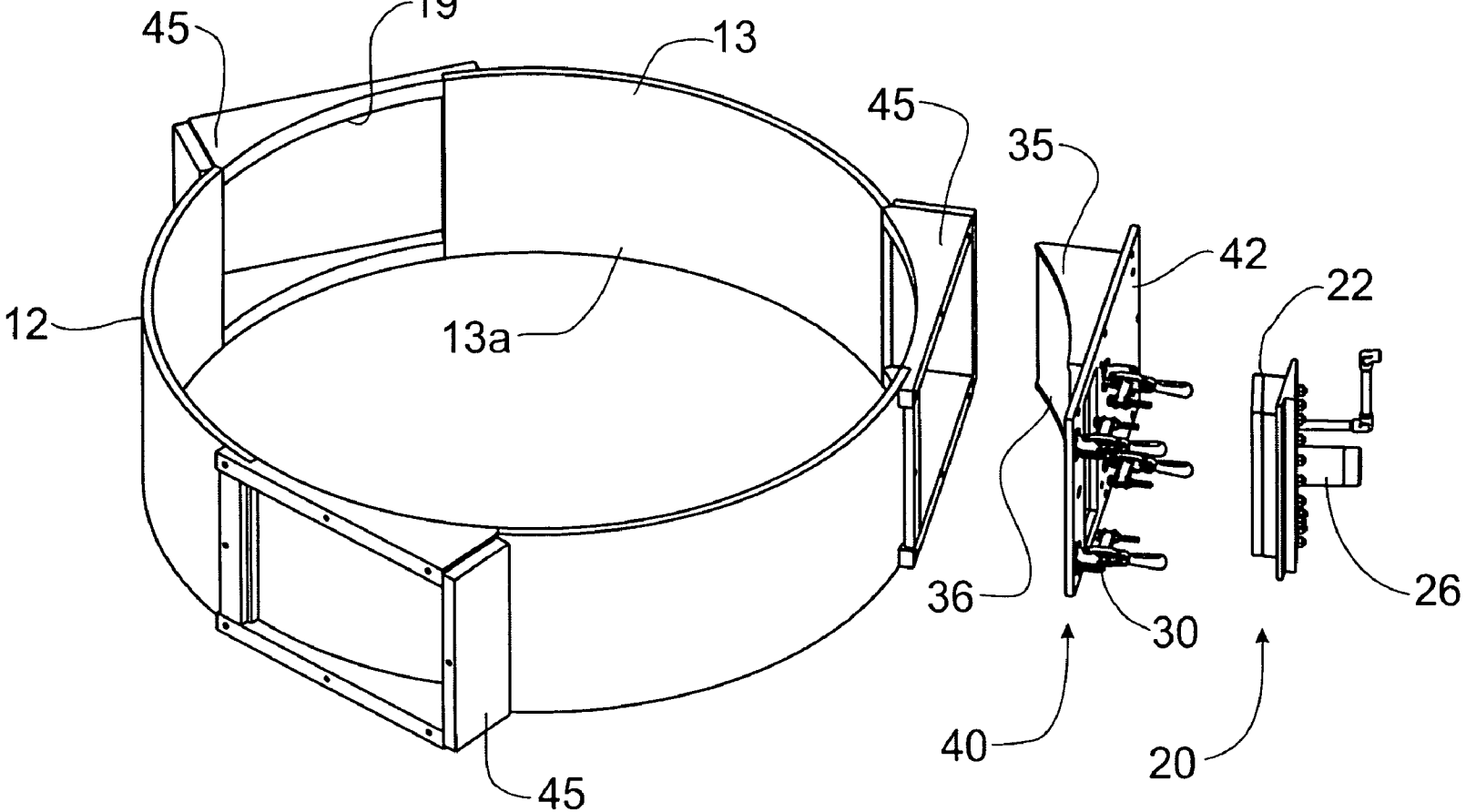
FIG. 6 is an exploded perspective view of the cylindrical chamber shown in FIG. 5, the wear plate module and the air knife module being exploded away from the side wall mount for the modules.

The wear plate 35 can be formed as part of a wear plate module 40, which is best seen in FIGS. 5-9. The wear plate module 40 includes a base member 42 that can be formed as a flat plate. The wear plate 35 would then be formed as an arcuate member that has a greater height dimension at the downstream side than at the upstream side, as is best seen in FIGS. 6, 8 and 9. The side wall 13 would be equipped with a mounting box 45 secured to the exterior surface 13*b* of the side wall 13 defining an opening that corresponds to the wear plate member 35. The base member 42 has an overall size that is larger than the wear member 35 so that a lip 43 is formed around the perimeter of the base member 42. This lip 43 engages the mounting box 45 to position the wear plate member 35 so that the interior surface 36 thereof is aligned with the interior surface 13*a* of the side wall 13 adjacent thereto. Removable fasteners can connect the base member 42 to the mounting box 45. Alternatively, clamping members (not shown), such as described above with respect to the mounting of the air knife module 20, could be utilized to provide a quick release of the wear plate module 40 to the mounting box 45. An O-ring (not shown) can be utilized between the lip 43 and the mounting box 45 to seal the connection therebetween.

The base member 42 is preferably formed to include an air knife opening 44 positioned upstream of the wear plate member 35 to locate the air knife assembly 20 adjacent the wear knife member 35. Accordingly, the mounting box 45 would have to be formed at an equivalent size to accommodate the insertion of both the wear plate member 35 and the air knife assembly 20. The air knife assembly 20 would preferably be formed in a modular configuration as described above to position the lip 25 against the exterior of the base member 42 and position the upstream edge of the block member 28 flush against the adjacent side of the side wall 13, while positioning the downstream edge slightly inwardly to locate the slot 29*a* inside of the interior side 13*a* of the side wall 13. The base member 42 can carry the clamping members 30 to secure releasably the air knife module 20 against the base member 42. Thus, the air knife module 20 can be removed separately from the wear plate module 40, or removed with the wear plate module 40 from the mounting box 45.

Figure 4:
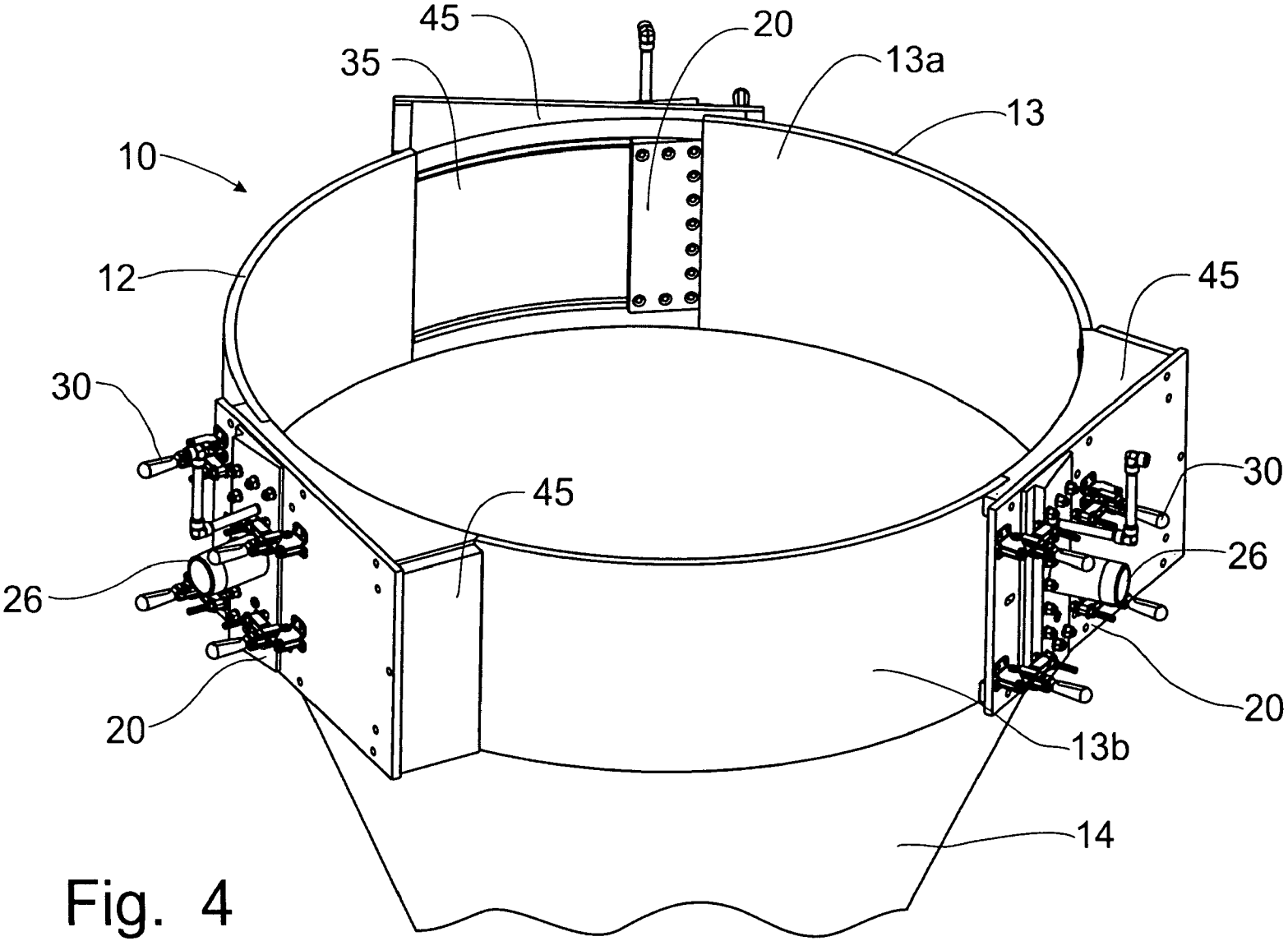
FIG. 4 is a perspective view of the cylindrical chamber of the comminuting and dehydrating machine with the top plate and air discharge structure removed for purposes of clarity.

As is depicted in FIG. 4, the cylindrical chamber 12 can be fabricated from a plurality of arcuate segments 49. Preferably, the number of arcuate segments 49 equals the number of air knife assemblies 20 spaced around the circumference of the cylindrical chamber 12. Accordingly, each of the arcuate segments 49 is formed with a corresponding portion of the side wall 13 and one of the openings 19 for the insertion of either the wear plate module 40 or the air knife module 20, depending on the embodiment of the cylindrical chamber 12. The individual segments 49 are welded together and ground smooth on the interior side 13*a* of the side wall at the joint between the adjoining segments 40 to present a smooth interior side wall surface 13*a* for the uninterrupted flow of entrained air around the circumference of the cylindrical chamber 12. Alternatively, the joint between the adjoining arcuate segments 49 could be formed with a lap joint (not shown) to facilitate the connection between the individual segments 49.

The configuration of the cyclonic comminuting and dehydrating machine 10 described above is particularly efficient in the grinding and dehydrating of municipal waste as part of a process that can reduce municipal waste into a fuel that can be burned to create energy. This energy can be used to generate electricity that can be consumed commercially, or utilized in the operation of the machine 10. Some materials, such as municipal waste, require pre-processing. For example, municipal waste would preferably have ferrous and non-ferrous metals removed from the stream of material to be fed into the comminuter 10, and the remaining material shredded to be presented in a fairly uniform particle size.

This configuration of the machine 10 described above is also capable of grinding many other materials from food stuffs to coal. An increase in air pressure for the air flow fed into the cylindrical chamber 12 results in a correspondingly increased comminuting power, including the time required for the material fed into the cylindrical chamber for grinding. However, certain materials may be most efficiently comminuted at certain specific and particular air pressures. Thus, the ability to change the depth of the slot 29*a* is important in the adaptation of the air knife assembly 20 to different products.

In the processing of municipal waste, the comminution of the waste material, due in a large extent to the co-mingling of the circulating entrained air flow with the incoming high pressure air flow from the air knife assembly 20, results in an atomization of some of the materials being processed, which is carried out of the comminuter 10 through the air discharge apparatus 17. Meanwhile, as is reflected in FIG. 11, the ground municipal waste material is dropped through the discharge opening 14*a* at the bottom of the conical chamber 14 onto a conveying device, preferably a conveyor belt 50. Municipal waste is a product that can have hazardous materials embedded into the raw material stream without the knowledge of the operator. The cyclonic comminuter 10 provides an opportunity to identify the hazardous material and remove the hazardous material for proper disposal.

Sensors 52 can be placed on the air discharge tube 17 to sense the quality of the air flow being discharged from the cyclonic comminuter 10. Such sensors 52 are known in the art, but the disposition of the sensors 52 on the air discharge apparatus 17 enables a processor 55 operatively connected to the sensors 52 to perform certain actions when the sensors 52 detect a hazardous material, such as (for example) lead or mercury, within the air flow being discharged. Once the level of a hazardous material reaches a threshold parameter, the processor 55 can signal a denaturing of the waste material being discharged onto the conveyor 50. For example, the processor 55 can direct a spray of a florescent paint, or some other indicator, from a de-naturing apparatus 58 onto the waste material being discharged from the conical chamber 14 until the hazardous material is below the threshold level. Preferably, the de-naturing of the stream of discharged ground material will continue for a predetermined length of time after the sensor 52 ceases to detect the presence of trace hazardous material within the discharged air above the predetermined threshold level.

Figure 11:
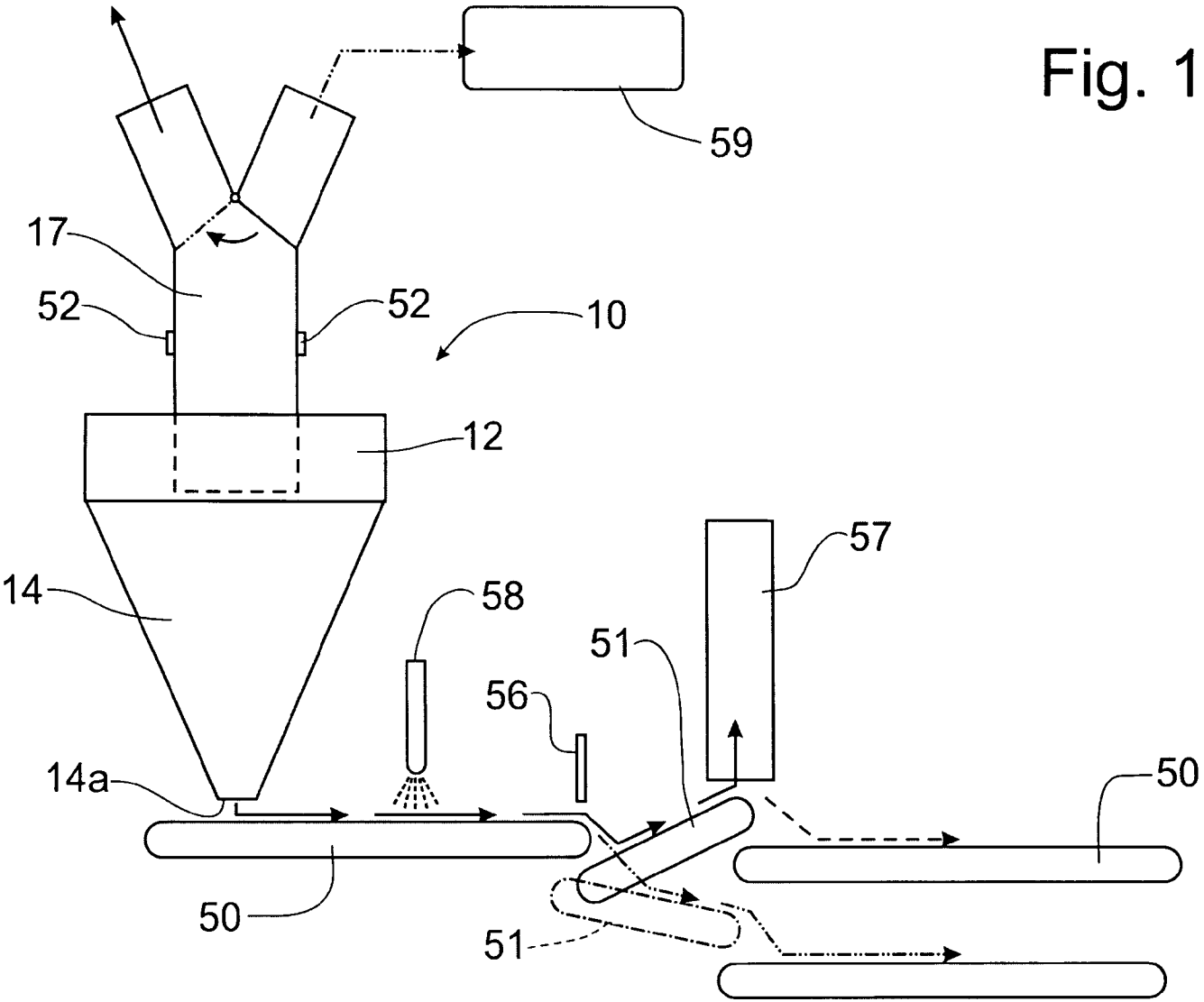
FIG. 11 is a schematic elevational view of a de-naturing apparatus that allows for the removal of a portion of the discharged ground material when a hazardous material is detected.

A second sensor 56, sufficiently far enough downstream along the conveyor belt 50 to permit the processor 55 to analyze the air discharge more thoroughly, is operable to detect the manner in which the ground waste stream on the conveyor belt 50 has been de-natured and activate a vacuum interceptor 57, or a trap door (not shown), deflector (not shown), or other form of interceptor, that will remove the de-natured ground waste material within which the hazardous material is located from the conveyor 50 so that the ground waste material can be properly disposed of. FIG. 11 schematically represents a second interceptor in the form of a section 52 of the conveyor 50 that changes direction upon activation by the processor 55 to direct the flow of ground waste material into a separate disposal line. The sequestered ground material can then be subsequently analyzed to determine with certainty the incorporation of the hazardous material. If not, the ground material can be redirected back to the primary stream of ground material.

Furthermore, the processor 55, upon detection of a hazardous material at a level in the air discharge through the air discharge mechanism 17 greater than a predefined threshold level, can activate a redirection of the flow of discharged air into a special filter 59, such as activated charcoal, or other device that would be operable to remove the trace hazardous material from the discharged air flow. The normal flow of discharged air may be filtered and cleansed in some known manner to remove any pathogens or other substances; however, the processor 55 can redirect the air flow into the special filter 59 that is specifically designed to remove the detected hazardous waste traces in the air flow.

It will be understood that other changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. A cyclonic comminuting and dehydrating machine for grinding and dehydrating material comprising:

a cylindrical chamber including a generally vertical, circular side wall having an upper edge and a lower edge, said cylindrical chamber further including a top plate mounted on said side wall along said upper edge thereof;

a conical chamber connected to said lower edge of said cylindrical chamber, said conical chamber including a discharge opening at a lower portion thereof for the discharge of ground material therefrom; and an air knife assembly inserted through an opening formed in said side wall and being connected to a source of compressed air, said air knife assembly having a vertically oriented slot positioned to direct a flow of pressurized air into said cylindrical chamber substantially tangentially to said side wall.

2. The machine of claim 1 wherein said air knife assembly is formed as a module and includes a housing defining an internal cavity in flow communication with said slot.

3. The machine of claim 2 wherein said housing has an interior face including an upstream edge and a downstream edge along which said slot is located, said upstream edge being mounted flush with a corresponding interior surface of said side wall, said downstream edge projecting inwardly from said interior surface of said side wall to position said slot to direct said flow of pressurized air tangentially along said interior surface of said side wall.

4. The machine of claim 3 wherein said housing is formed with a lip extending around the perimeter of said housing, said lip being engagable with an exterior surface of said side wall to secure said air knife module against said cylindrical chamber.

5. The machine of claim 4 wherein said housing is secured into said cylindrical chamber by releasable clamping members that allow a quick release of said air knife module from said cylindrical chamber.

6. The machine of claim 3 wherein said cylindrical chamber is formed with a removable wear plate secured along said interior surface of said side wall adjacent said downstream edge of said air knife assembly.

7. The machine of claim 6 wherein said wear plate is attached to a base plate and forms a module that can be removed from said cylindrical chamber.

8. The machine of claim 7 wherein said opening is sized to allow passage of said wear plate module, said base plate defining a lip that is engagable with a mounting box formed on an exterior surface of said side wall to position the wear plate such that an interior face of said wear plate is aligned with said interior surface of said side wall.

9. The machine of claim 7 wherein said base member is formed with an air knife opening therein for the passage of said air knife assembly, said housing of said air knife assembly being engagable with said base member to locate said interior face of said housing relative to said interior surface of said side wall.

10. In a cyclonic comminuting and dehydrating machine having a cylindrical chamber including a vertically oriented circular side wall on which a top plate is mounted; a conical chamber in flow communication with said cylindrical chamber and extending downwardly therefrom; an air inlet apparatus associated with said cylindrical chamber to direct a flow of air into the cylindrical chamber; and an air discharge device to allow said air to be discharged from said cylindrical chamber, the improvement comprising:

a wear plate detachably affixed to said side wall adjacent said air inlet apparatus and being positioned downstream from said air inlet apparatus, said wear plate being recessed into a pocket formed in said side wall such that an interior face of said wear plate is contiguous to a corresponding interior face of said side wall.

11. The machine of claim 10 wherein said pocket is an opening in said side wall, said wear plate being formed as a module including a base member mounted to position said wear plate relative to said side wall.

12. The machine of claim 11 wherein said side wall is formed with a mounting box supported on an exterior surface of said side wall, said base member forming a lip around the periphery of said wear plate to engage said mounting box and located said wear plate relative to said side wall.

13. The machine of claim 12 wherein said base member is formed with an air inlet opening therein for the passage of an air knife module defining said air inlet apparatus.

14. The machine of claim 13 wherein said air knife module comprises:

a housing defining an internal cavity and a vertically oriented slot positioned to direct a flow of pressurized air into said cylindrical chamber substantially tangentially to said side wall, said slot being in flow communication with said cavity, said housing having an interior face including an upstream edge and a downstream edge along which said slot is located, said upstream edge being mounted flush with a corresponding interior surface of said side wall, said downstream edge projecting inwardly from said interior surface of said side wall to position said slot to direct said flow of pressurized air tangentially along said interior surface of said side wall.

15. The machine of claim 14 wherein said housing comprises:

a base block member defining said cavity;

a cap block affixed to said base block member; and a gasket positioned between said base block member and said cap block to form a seal between said base block member and said cap block, said gasket leaving unsealed a portion between said base block member and said cap block to create said slot.

16. In a cyclonic comminuting and dehydrating machine having a cylindrical chamber including a vertically oriented circular side wall on which a top plate is mounted; a conical chamber in flow communication with said cylindrical chamber and extending downwardly therefrom; an air inlet apparatus associated with said cylindrical chamber to direct a flow of air into the cylindrical chamber; and an air discharge device to allow said air to be discharged from said cylindrical chamber, the improvement comprising:

an air knife module detachably supported from said side wall and defining a vertically oriented slot for the introduction of a pressurized air flow along an interior surface of said side wall in an orientation that is substantially tangential thereto, said air knife module having an interior face including an upstream edge and a downstream edge along which said slot is located, said upstream edge being mounted flush with a corresponding interior surface of said side wall while said downstream edge projects inwardly from said interior surface of said side wall to position said slot so as to direct said flow of pressurized air tangentially along said interior surface of said side wall.

17. The machine of claim 16 wherein said air knife module is mounted on a wear plate module detachably affixed to said side wall, said wear plate module comprising:

a base member detachably connectable to said side wall; and a wear plate member affixed to said base member and projectable through an opening in said side wall to locate an interior face of said wear plate member contiguous with a corresponding interior surface of said side wall.

18. The machine of claim 17 wherein said cylindrical chamber is formed from a plurality of arcuate segments, each said arcuate segment including one of said wear plate modules and one of said air knife modules.

19. The machine of claim 17 wherein said base member is formed with an air knife opening through which said air knife module is inserted to locate said interior face thereof relative to said interior surface of said side wall.

20. A cyclonic comminuting and dehydrating machine for grinding and dehydrating material comprising:

a cylindrical chamber including a generally vertical, circular side wall having an upper edge and a lower edge, said cylindrical chamber further including a top plate mounted on said side wall along said upper edge thereof;

a conical chamber connected to said lower edge of said cylindrical chamber, said conical chamber including a discharge opening at a lower portion thereof for the discharge of ground material therefrom;

a conveyor positioned to receive ground material discharged from said conical chamber and to direct a stream of discharged ground material away from said cyclonic comminuting and dehydrating machine;

an apparatus for directing a flow of air into said cylindrical chamber to create a flow of air in a circular pattern within the cylindrical chamber;

an air discharge apparatus in flow communication with said cylindrical chamber to remove air from said cyclonic comminuting and dehydrating machine, said air discharge apparatus including a first sensor for detecting traces of hazardous waste within said the air flow passing through said air discharge apparatus; and a de-naturing apparatus operatively associated with said conveyor to de-nature said stream of discharged ground material after being discharged from said conical chamber in response to said first sensor detecting said traces of hazardous waste above a predetermined threshold level corresponding to said stream of discharged material being de-natured.

21. The machine of claim 20 further comprising:

a second sensor associated with the conveyor to detect the de-natured stream of discharged ground material; and an interceptor to remove the de-natured stream of discharged ground material from said conveyor.

22. The machine of claim 21 wherein said de-naturing apparatus is a spray device to spray a detectable substance onto said stream of discharged ground material.

23. The machine of claim 22 wherein said detectable substance is paint.

24. The machine of claim 21 wherein said interceptor is a vacuum apparatus to remove the de-natured stream of discharged ground material from the conveyor.

25. The machine of claim 21 wherein said interceptor is a section of said conveyor that is movable to redirect the flow of said de-natured stream of discharged ground material into a supplemental conveyor.

26. The machine of claim 21 further comprising a processor operatively coupled to said first sensor, said second sensor and said interceptor to affect operation thereof.

27. The machine of claim 26 wherein said processor is also operable to redirect the discharged air flow into a filtration apparatus while said first sensor detects said trace of hazardous material above said threshold level.

* * * * *